United States Patent [19]

Baron

[11] Patent Number: 4,750,624

[45] Date of Patent: Jun. 14, 1988

[54] EXTRUDED PANEL

[75] Inventor: Peter Baron, Bondi Junction, Australia

[73] Assignees: Australian Slatwall Industries Pty. Ltd.; Enrobear Limited, both of New South Wales, Australia

[21] Appl. No.: 924,305

[22] Filed: Oct. 29, 1986

[30] Foreign Application Priority Data

Jul. 18, 1986 [AU] Australia ..... PH7015

[51] Int. Cl.[4] ..... A47F 5/08

[52] U.S. Cl. ..... 211/87; 211/189; 52/588; 52/221

[58] Field of Search ..... 211/87, 189, 94; 52/588, 221; 40/16; 403/DIG. 10; 248/542

[56] References Cited

U.S. PATENT DOCUMENTS

| | | | |
|---|---|---|---|
| 3,100,556 | 8/1963 | De Ridder | 52/588 |
| 3,352,428 | 11/1967 | Sak et al. | 211/87 |
| 3,698,565 | 10/1972 | Weber | 211/87 |
| 4,323,163 | 4/1982 | Johns | 52/588 X |
| 4,410,095 | 10/1983 | Dembricks | 211/87 X |
| 4,420,087 | 12/1983 | Johns | 211/189 |
| 4,450,970 | 5/1984 | Shepard | 52/588 X |
| 4,567,698 | 2/1986 | Morrison | 160/135 X |
| 4,579,308 | 4/1986 | Jensen | 211/87 X |
| 4,598,504 | 7/1986 | Itagaki | 211/87 X |
| 4,603,068 | 7/1986 | Hunter . | |
| 4,607,753 | 8/1986 | Radek | 211/87 |

FOREIGN PATENT DOCUMENTS

| | | |
|---|---|---|
| 64200 | 12/1973 | Australia . |
| 86913 | 3/1982 | Australia . |
| 3221 | 11/1985 | Australia . |
| 2067388 | 1/1980 | United Kingdom . |
| 2160003 | 5/1985 | United Kingdom . |

OTHER PUBLICATIONS

Comalco Catalogue.

*Primary Examiner*—Ramon S. Britts
*Assistant Examiner*—Blair M. Johnson
*Attorney, Agent, or Firm*—Ladas & Parry

[57] ABSTRACT

An integrally extruded longitudinally extending panel which can be connected to other such panels to provide an upright display surface having channels therein comprises a planar panel portion, channel means at one side of the panel portion and comprising first connecting means, and second connecting means at the other side of the panel portion; the first and second connecting means of adjacent panels being interconnectable to provide a display surface having a channel therein with an overhanging lip for retaining in the channel the foot of a display means such as a bracket, shelf, hanger, light fitting, etc. The connection between the panels is arranged to be concealed by overlap in the region of the channel.

8 Claims, 2 Drawing Sheets

EXTRUDED PANEL

FIELD OF THE INVENTION

The present invention relates to an extruded panel which can be connected to other such panels to provide an upright display surface having longitudinally extending channels therein. Each channel is provided with an overhanging lip for allowing display means, such as brackets, shelves, hangers and light fittings, to be hooked into the channel. This provides a display surface of great versatility capable of displaying a wide range of articles, for example in a shop or warehouse.

PRIOR ART

A display system of the same general type is disclosed in Australian patent specification No. 43225/85 which describes a wooden panel which has been routed to provide a series of longitudinal channels of T-shaped cross-section. The edges of the channels tend to be prone to breakage under the weight of the displayed articles. Australian patent specification No. 58077/86 discloses an aluminium extrusion of complementary cross-section to the channel, which fits inside the channel thereby strengthening the channel and improving is visual appearance.

SUMMARY OF THE INVENTION

The present invention relates to a development of this general concept whereby the display surface can be built up from a number of extruded panels and where the join between adjacent panels is concealed within the channel, and where the fixing of a panel to the wall is preferably also concealed by an adjacent panel.

The present invention provides a longitudinally extending extruded panel for providing an upright display surface having longitudinally extending channels therein, which comprises a substantially planar panel portion;

longitudinally extending channel means provided at one lateral side of the panel portion and comprising first longitudinally extending connecting means;

second longitudinally extending connecting means provided at the other lateral side of the panel portion;

said first connecting means being engagable with said second connecting means for another such extruded panel to provide an upright display surface having a longitudinally extending channel, the channel having an overhanging lip at an upper side for retaining in the channel a foot of a display means.

In the completed display surface, the substantially planar panel portion will generally constitute the majority of the surface area. As such, it may be provided with any known decorative surface treatment. The panel portion may also be provided with longitudinally extending flange portions for allowing a decorative infill sheet, for example of a plastics sheet material, mirror or sign to be slid or snapped onto the front of the panel portion. In such a case, the panel portion may be punched to provide regular apertures to allow access to cabling concealed behind the panel. The panel portion will be substantially planar but could be slightly curved or ribbed across its lateral extent. Moreover, the panel after extrusion could be rolled to provide a panel which was slightly curved along its longitudinal extent, so as to provide a display surface for use against a curved wall.

If required, a further channel could be provided within the planar panel portion.

The panel will normally be extruded from aluminium or a plastics material.

Preferably, a spacer will extend rearwardly from the planar panel portion to space the panel portion away from a wall, and so to provide an enclosed space for trunking cables or other utilities. It also adds to the strength of the panel.

The channel formed between two adjacent extruded panels may be T-shaped in cross-section (i.e. with an upper and lower overhanging lip) or may simply have an upper overhanging lip. The overhanging lip acts to retain the foot of a display means fitted into the channel. Preferably, a complete channel with overhanging lip is provided on each extruded panel, since this provides the strongest arrangement. Alternatively, the overhanging lip could be provided by one panel and the rest of the channel by the adjacent panel.

The channel may be provided at either the upper or lower side of the panel portion.

In one preferred embodiment, the extruded panel comprises a T-section portion, one arm of the T providing said overhanging lip, whilst the other arm provides said first connecting means for interconnecting the panels.

Preferably, the second connecting means is arranged to be hooked or clipped over the first connecting means.

In a preferred embodiment, the extruded panel comprises a flange portion through which screws, nails or rivets can be driven for attaching the panel to a wall. This is usually behind the first and second connecting means so as to be concealed when the display surface has been assembled.

The base of the channel may be provided with nibs for retaining a further decorative sheet, if desired.

BRIEF DESCRIPTION OF THE DRAWINGS

Embodiments of the present invention, will now be described by way of example only with reference to the accompanying drawings, wherein:

FIG. 1 shows part of a first extruded panel 1 connected to a second extruded panel 2.

DETAILED DESCRIPTION OF THE DRAWINGS

Figure 1:
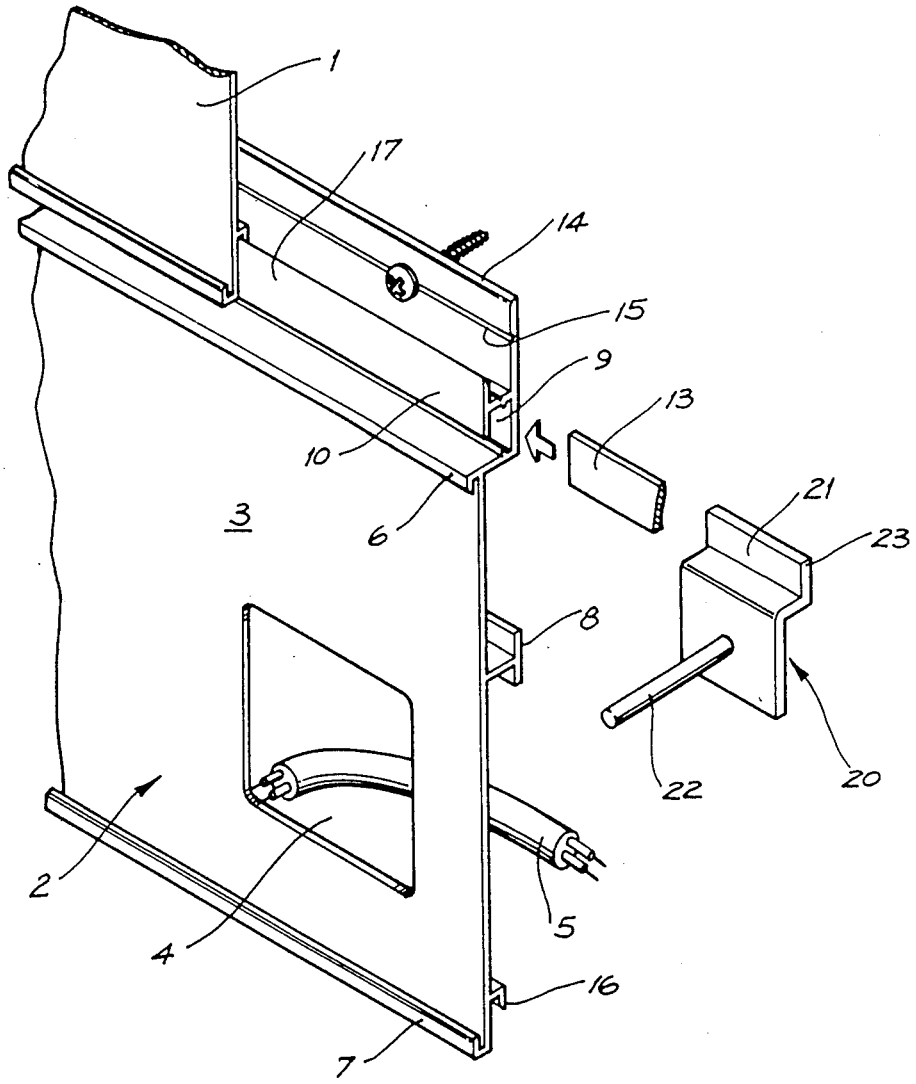
FIG. 1 is a perspective view of a pair of interconnected extruded panels and showing part of a display means for insertion into a channel.

Each extruded panel comprises a panel portion 3 provided with a punched aperture 4 through which cabling 5 may be passed. At its upper and lower edges the panel portion comprises overhanging flanges 6, 7 for holding a decorative sheet, for example of a plastics laminate material, onto the panel portion and thereby concealing the apertures 4. A spacer 8 extends rearwardly from the panel portion 3 for spacing the panel portion away from a wall.

Figure 2:
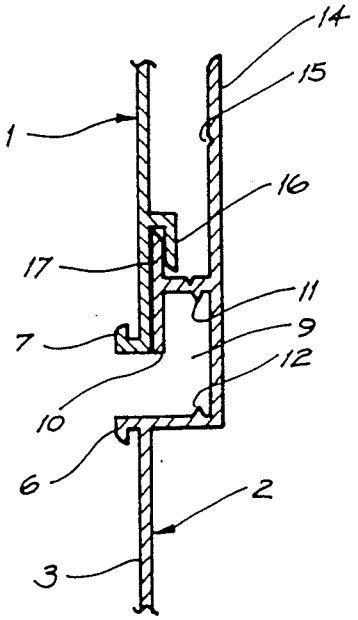
FIG. 2 is a cross-section to an enlarged scale of the channel between two adjacent panels.

At an upper side, the extruded panel comprises a channel 9 having an overhanging lip 10. As shown in FIG. 2, a pair of nibs 11, 12 are provided in the base of the channel 9 so as to allow a decorative plastics laminate 13 to be slid into the base of the channel.

The base of the channel is extended to form a fixing flange 14 having a groove 15 through which screws or nails may be driven for fixing the extruded panel to a substrate.

At a lower side, the extruded panel is provided with a hook portion 16 adapted to hook over an upwardly extending portion 17 extending from the overhanging lip 10.

The extruded panel may be used as follows. In order to provide a display surface over a wall, a lowermost extruded panel is screwed onto the wall through the fixing flange 14. Spacer 8 spaces the panel portion 3 away from the wall thereby providing a conduit through which cables may be passed. A second extruded panel is then connected to the first by hooking hook portion 16 over extension 17 so that the second extruded panel is held in place by gravity. The second extruded panel is then screwed to the wall in the same way as the first. The join between the two extruded panels is hidden, since the lower side of the second panel overlaps the overhanging lip 10 of the first panel. This procedure is repeated until the complete display surface has been assembled. Either before or after installation of the extruded panels, decorative plastics laminates are slid or slipped onto the front of the panel portion 3 and into the base of the channel 9, if desired.

For display of goods, a display means 20 (only partially shown) is hooked into the channel 9 so that a toe 23 of foot 21 of the display means is hooked behind the overhanging lip 10 thereby retaining it in position. An arm 22 depends from the display means and carries a shelf, bracket or similar arrangement for displaying goods. The display system is very versatile as the display means can be inserted at any point along the length of a channel and a wide variety of different display means can be used depending on the goods being displayed.

Figure 3:
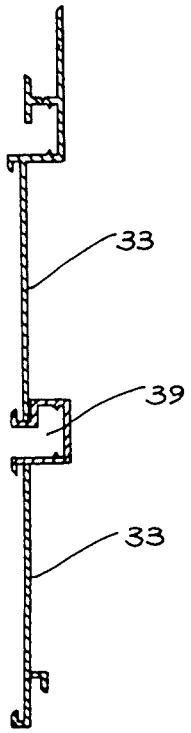
FIG. 3 is a cross-section of another embodiment having an additional channel provided in the panel portion.

FIG. 3 shows another embodiment of the present invention which is identical to the first embodiment except that a further channel 39 is provided centrally in the planar panel portion 33.

I claim:

1. A longitudinally extending extruded panel adapted such that the panel may be connected to other such panels so as to assemble an upright display surface having a plurality of longitudinally extending channels therein, said panel comprising:

a substantially planar panel portion having upper and lower edges;

longitudinally extending channel means defining a mouth provided at the upper edge of the panel portion, the channel means extending rearwardly of the upper edge such that the mouth is adjacent thereto, the channel means comprising first longitudinally extending connecting means and comprising an overhanging lip at the upper edge thereof for retaining in the channel means a foot of a display means, the foot having a toe which is hooked behind the lip and a heel which abuts a lower edge of the channel means, the first longitudinally extending connecting means and the overhanging lip being in a T-configuration, whereby one arm of the T provides the overhanging lip and the other arm of the T provides an upwardly extending portion which constitutes said first connecting means for interconnecting the panels, a complete channel including said overhanging lip being provided on one said extruded panel;

second longitudinally extending connecting means provided at the lower edge of the panel portion and being arranged to hook over said first connecting means of another such extruded panel so as to provide said upright display surface having longitudinally extending channels therein and such that the lower edge of the panel portion overlaps the overhanging lip of said other panel so as to hide the connection between the panels;

an integrally extruded fixing flange extending upwardly from the rear of the channel for abutting a wall as to allow the panel to be fixed to the wall, the fixing flange extending upwardly beyond the adjacent first connecting means such that the fixing flange is concealed by the connection of said another such extruded panel; and the panel portion and the mouth of the channel means having relative widths such that in the assembled display surface the panel portions constitute a majority of the surface area.

2. An extruded panel according to claim 1 which further comprises longitudinally extending flange portions provided along opposed edges of the panel portion, the flange portion being provided with inwardly directed free edges extending towards one another so as to allow a decorative infill sheet to be overlaid and retained on the front of the panel portion.

3. An extruded panel according to claim 2 wherein an aperture is provided in the panel portion to allow access to utilities concealed behind the panel, the aperture being hidden when said decorative infill sheet overlies the front of the panel portion.

4. An extruded panel according to claim 1 wherein a further longitudinally extending channel provided with an overhanging lip at an upper side for retaining in the channel a foot of a display means is integrally extruded intermediate the upper and lower edges of the panel portion.

5. An extruded panel according to claim 1 which further comprises a rearwardly extending longitudinal spacer limb depending from the rear of the panel portion, for abutting a wall so as to space the panel portion away from a wall and to provide an enclosed space for trunking utilities, the limb extending rearwardly to an extent such that the panel portion is mounted substantially parallel to the wall.

6. An extruded panel according to claim 1 wherein the second connecting means is arranged to be hooked or clipped over the first connecting means, and which comprises a longitudinally extending portion which is hook-shaped in cross-section and which depends rearwardly from a lower portion of the rear of the panel portion.

7. An extruded panel according to claim 1 wherein the lowerward extent of the panel is such that, when two such panels have been connected together, the lower edge of the upper panel overlaps the overhanging channel lip so as to hide the connection between the panels.

8. A display assembly which comprises a plurality of interconnected panels, each according to claim 1; and a display means having a foot capable of being retained in said channel with a toe of said foot being hooked behind the overhanging lip.

* * * * *